United States Patent [19]

Otzen

[11] 4,160,603

[45] Jul. 10, 1979

[54] IMMERSION CLEANER

[75] Inventor: Karl G. Otzen, Brookfield, Wis.

[73] Assignee: Safety-Kleen Corp., Elgin, Ill.

[21] Appl. No.: 919,361

[22] Filed: Jun. 26, 1978

Related U.S. Application Data

[62] Division of Ser. No. 808,169, Jun. 20, 1977, Pat. No. 4,096,873.

[51] Int. Cl.[2] ..... B08B 3/04; B01F 7/32

[52] U.S. Cl. ..... 366/219; 74/99 A; 134/135; 134/140; 134/158; 134/161; 134/162; 366/242; 366/277

[58] Field of Search ..... 366/219, 232, 234, 237, 366/240, 242, 243, 255, 277; 134/135, 140, 158, 161, 162, 143, 149, 157; 74/99 R, 99 A

[56] References Cited

U.S. PATENT DOCUMENTS

| | | | |
|---|---|---|---|
| 1,559,346 | 10/1925 | Moore | 134/157 |
| 1,741,329 | 12/1929 | Montgomery | 134/143 |
| 1,836,337 | 12/1931 | Riblett | 134/140 |
| 2,060,277 | 11/1936 | Butts | 134/135 |
| 2,566,819 | 9/1951 | Baltsois | 134/135 |
| 2,692,603 | 10/1954 | Foote | 134/158 |
| 3,227,166 | 1/1966 | Martz | 134/161 |
| 3,812,943 | 5/1974 | Quemerais | 74/99 A |

*Primary Examiner*—Robert W. Jenkins
*Attorney, Agent, or Firm*—James T. FitzGibbon

[57] ABSTRACT

An immersion cleaner for parts and other articles. The cleaner includes a receptacle for articles, a cover unit for a container of cleaning liquid, a cam plate unit disposed on the cover and including a circumferentially extending cam track surface having axially undulating portions, and a combination receptacle support and cam follower unit. The follower rotates about a vertical axis and is disposed in the use above the cam plate. The receptacle support unit includes means adapted to engage the cam track and to ride thereover upon oscillation of said support unit about its axis. A rod is attached to a portion of the support unit and forms an operative connection between the receptacle and the support unit. The support unit is driven in an oscillating mode. This causes the receptacle to swing through an arc and to rise and fall simultaneously.

6 Claims, 9 Drawing Figures

FIG. 5
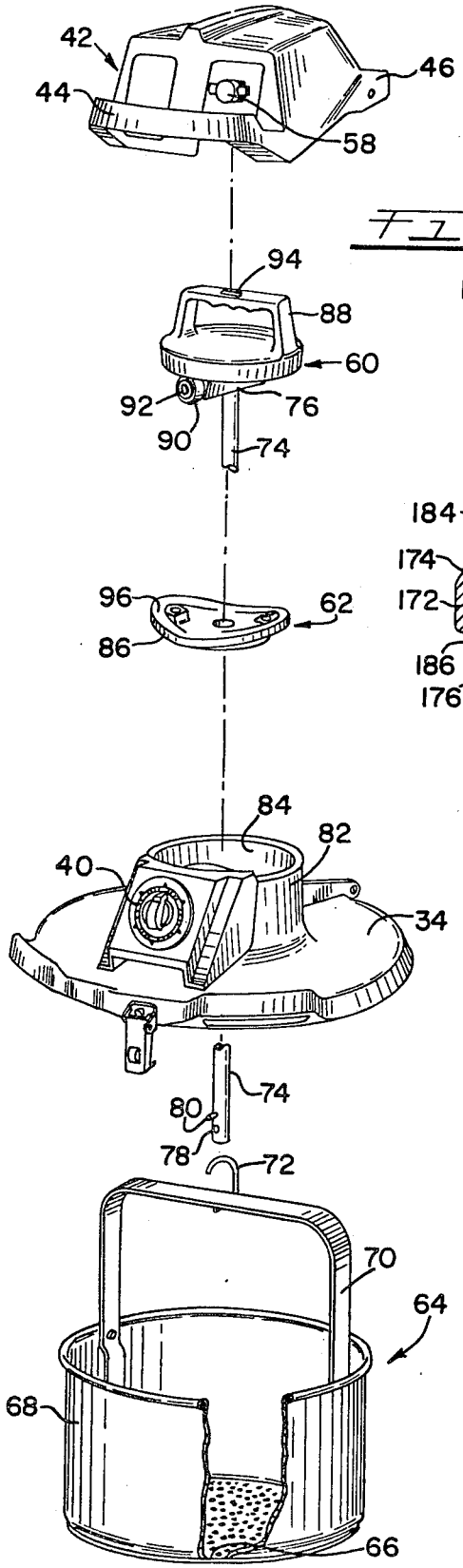
FIG. 6
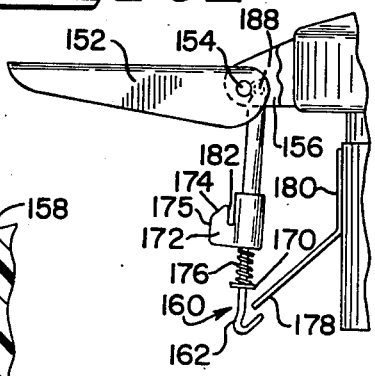
FIG. 7
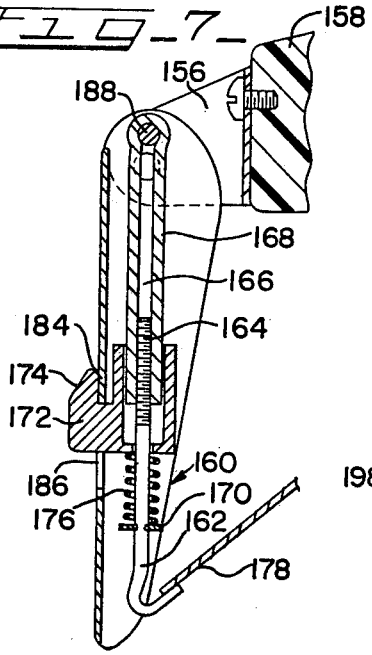
FIG. 8
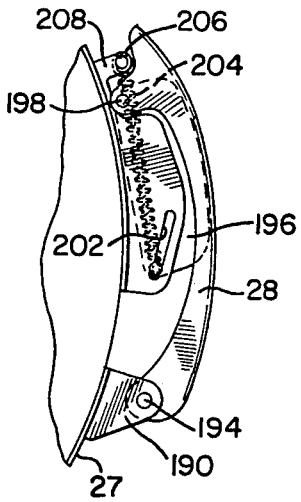
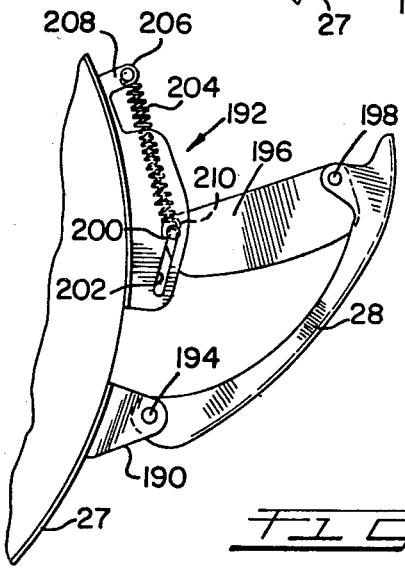
FIG. 9

IMMERSION CLEANER

This is a divisional of U.S. application Ser. No. 808,169, filed June 20, 1977, now U.S. Pat. No. 4,096,873.

BACKGROUND OF THE INVENTION

The present invention relates generally to article washers and more particularly to so-called immersion cleaners which are adapted to clean parts or complete articles by soaking and agitating them in a solvent, an emulsion, or other cleaning fluid.

With the improvement in the technology of solvents and emulsion type cleaners, it has become possible in recent years to clean certain assemblies by immersion and agitation rather than by disassembly and cleaning of individual parts. For example, automotive parts such as carburetors, which tend to accumulate gum, sludge and scale, are now often able to be cleaned by immersion for a period of time in suitable chemical bath.

Certain other parts having a plurality of interior chambers or passages are now also able to be cleaned effectively by cleaners suitably compounded to contain a desired combination of chemical solvating groups, surface active agents, or acidic or basic chemical characteristics.

For example, compounds containing phenols, cresols and compounds derived therefrom are effective to remove certain types of scale and encrusted carbon. Other compounds which are of a relatively high pH are effective to clean aluminum, and certain solvents having plural functional groups are able to clean gums and varnishes which accumulate on parts exposed to fuels or other compositions which differ chemically from the solvents. Solvents which contain hydroxyl groups, ketone groups or chlorinated hydrocarbon groups are able to clean residues such as varnish and the like, which are relatively insoluble in gasoline, and which gradually deposit therefrom and build up on carburetors, for example.

Considering the progress which has been made with chemical cleaners of the type discussed above, there has been an increased interest in immersion cleaners or the like article washers which are able to provide the required mechanical action to parts immersed in the liquids just described, and which can do so without creating additional undesirable side effects. Desirable machines are those which do not cause the chemicals to volatilize, and which do not generate excessive heat and which, preferably, do not involve the use of exotic techniques such as ultrasonic energy or the like.

Thus, an immersion cleaner which would be compatible with the environment and which would be safe and easy to use would not only be satisfactory from a functional standpoint, but would be very desirable for use by persons whose jobs require them to clean parts and assemblies of the type described above.

In view of the requirements for an immersion cleaner which possesses good cleaning action, simple operating characteristics, and which is compatible with the environment, it is an object of the invention to provide an improved immersion cleaner.

Another object of the invention is to provide a parts cleaner unit which can be affixed to and fitted in sealed relation over the top of a container for cleaning fluids.

Another object is to provide an improved cleaner for mechanical assemblies which will create a dual axis mechanical motion as well as removably immersing parts in a cleaning fluid.

Another object is to provide a cleaning apparatus which is easy to load, unload, and to service periodically.

A still further object of the invention is to provide a cleaner apparatus in which a compound or two axis motion is imparted to the articles to be cleaned as well as one in which the articles may be immersed in the cleaning fluid for any predetermined length of time.

Another object is to provide a parts cleaner or cleaner apparatus for mechanical articles which may be readily fastened over a solvent container and which may be easily removed therefrom.

A still further object is to provide an article cleaner which does not utilize the application of high level energy to the cleaning fluid and which reduces or contains any undesirable tendency of the fluid to volatilize in use.

Another object of the invention is to provide a cleaning apparatus which, in use, may be powered by an air operated motor and which, without change of design, may be adapted for manual operation.

Another object is to provide an article cleaning apparatus which is power operated and which includes a novel powerhead assembly adapted to cooperate with the load supporting portion of the article in a unique drive connection.

Another object is to provide a parts cleaning apparatus which includes means for imparting rotary motion to the article carrier as well as means for imparting an axially undulating motion thereto for an improved cleaning action.

Still another object is to provide an immersion type cleaner which operates on a simplified basis and which achieves a good cleaning action by use of a cam plate having a cam track supporting a load carrier unit which rolls over a portion of the cam track in use.

A still further object is to provide an apparatus for washing articles which includes means for receiving the articles, means for carrying the article receiver, a cam plate for imparting an axially undulating motion to the carrier, and means for connection to a power or energy source to impart the desired motion to the basket or other carrier for the articles.

A still further object of the invention is to provide a carrier which includes a motor carrying head disposed above the remainder of the article washer, in which the head is mounted for a pivotal movement, and in which the head oscillates in use through a small arc while resting atop a driven portion of the apparatus which in turn carries the load comprised of the basket or article receiving receptacle and the articles themselves.

Yet another object is to provide an article washing apparatus which can use a readily available power source such as compressed air commonly found in shops, service stations and the like.

Another object is to provide an article cleaning apparatus which is readily serviced and has a relatively simple and straight-forward construction.

A still further object of the invention is to provide an apparatus in which the rotary portion of the motion is supplied by a drive element, and in which the axial portion of the motion is supplied by imparting an axially undulating movement to the article carrier through a cam plate and cam follower assembly.

The foregoing and other objects and advantages of the invention are achieved in practice by providing an article washer which includes an assembly receivable over a container and adapted to be affixed thereto, a receptacle for receiving the article to be cleaned, a cover for the container which includes a cam track element, a carrier for connection to the article receptacle, and means for imparting an oscillating motion to the article carrier.

Further objects are achieved by providing an article cleaner of the type referred to above, and which further includes a pivotally mounted head unit disposed above the carrier, and a motor and a portion operatively connected therewith for driving engagement with the article carrier.

The exact manner in which these and other objects and advantages of the invention are achieved in practice will become more clearly apparent when reference is made to the following detailed description of the preferred embodiments of the invention set forth by way of example and shown in the accompanying drawings, in which like reference numbers indicate corresponding parts throughout.

BRIEF DESCRIPTION OF THE DRAWINGS

FIG. 5 is an exploded view showing the relation of the principal components of one form of the apparatus of the invention, and showing, from top to bottom, the powerhead, the load support and cam follower unit, the load support rod, the cam plate, the cover and cam plate support unit, and the receptacle for the articles to be cleaned;

FIG. 6 is a side elevational view, with parts broken away, on an enlarged scale, showing a form of the latching element for the cover assembly;

FIG. 7 is a further enlarged vertical sectional view of the latch assembly of FIG. 6;

FIG. 8 is a top plan view, with portions broken away, showing the clamp assembly for securing the unit to the container for the cleaning fluid; and FIG. 9 is a top plan view of the clamp, showing the same in opened position.

DESCRIPTION OF THE PREFERRED EMBODIMENTS OF THE INVENTION

While it will be understood that the principles of the invention may be applied to other structures, two preferred forms of apparatus will be described in detail, one of which shows the invention to be embodied in a cleaning unit which is actuated by an air powered or similar motor and the other of which comprises an immersion cleaner in which motion is imparted to the receptacle for the articles by manual means.

Figure 1:
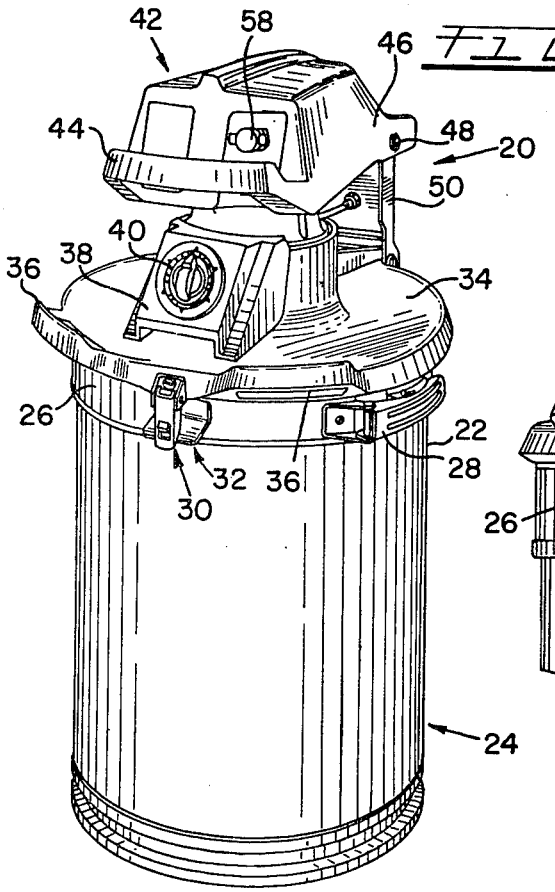
FIG. 1 is a perspective view of one form of immersion cleaner made according to the invention and showing the cleaner to be disposed in position of use over a receptacle for the container for the cleaning fluid.

Referring now to the drawings in greater detail, FIG. 1 shows the invention to be embodied in an immersion cleaner unit generally designated 20, disposed atop the upper portion 22 of a container generally designated 24 which receives a quantity of cleaning fluid in which the articles will be immersed in the use of the apparatus.

By "cleaning fluid" as used herein is meant any fluid which is capable of cleaning the articles in question. It may typically be a solvent, such as, for example, a chlorinated hydrocarbon, another active solvent, or an emulsion or water solution of any organic or inorganic cleaning chemical, or any combination of such chemicals, solutions or emulsions.

The cleaner unit 20 surmounting the container 24 is shown to be affixed by means of a container clamp assembly 26 which encircles the upper margin 22 of the container 24. The clamp assembly 26 preferably includes a strap portion 27 made from flexible steel or the like, secured in place by a clamp handle 28, which will be described in detail hereafter. FIG. 1 also shows that a cover latch 30 is provided for cooperation with a locking flange 32 on the clamp 26, so as to hold the unit in place atop the container.

Another principal component of the cleaner unit 20 is a combination container cover and cam plate support assembly 34 which includes a pair of cover handles 36 for raising the cover assembly 34 as will be described herein. The cover 34 includes a housing 38 for a timer; a timer knob and dial assembly 40 is disposed on the front face of the housing 38.

A power head generally designated 42 is disposed over the central portion of the cover, and this head 42 includes a front handle portion 44 and rear, lower body brackets 46 which are mounted for pivotal movement by the fasteners 48 which secure the head 42 to a head mounting bracket 50. This bracket 50 is in turn attached to a bracket 52 on the clamp 26 by a lower pivot 54. A motor speed control 58 is disposed on the front portion of the housing and the operation thereof will be described in detail elsewhere herein.

Referring now to FIG. 5, the general arrangement of the principal elements of the invention are shown, and these include the head 42, having the handle 44, the pivot brackets 46, and the speed controls 58.

These elements are disposed above another principal element, namely, the load support and cam follower unit generally designated 60, the cam plate generally designated 62, the cover plate and cam support 34, referred to above, and a receptacle generally designated 64 for receiving the articles. As shown in FIG. 5, the receptacle includes a perforated bottom wall 66, generally circular sidewalls 68, and a bail portion 70 to which is attached a mounting hook 72. A receptacle support rod 74 is received within the axle housing 76 of the cam follower 60, and the lower end of the rod 74 includes an opening 78 for receiving the hook 72 as well as a stop pin 80 which limits upward movement of the rod 74.

The container cover 34 is shown to include a neck portion 82 having generally cylindrical, inwardly directed center sidewalls 84. These walls 84 are just larger than the outer axially extending surfaces 86 of the cam plate 62, and serve to locate the cam plate in the desired position within the cover of the unit as will be detailed herein.

Referring again to the load support and cam following unit 60, it will be shown to include a lifting handle portion 88 at the top thereof, and follower wheels 90 journaled on the axle 92 extending through the axle housing 72. The horizontally extending or bight portion of the lifting handle 88 includes a central, generally oval shaped recess 94 in the upper surface thereof, which recess 94 is adapted to receive the nose portion of a driving member extending downwardly from the power unit, as will appear. From the arrangement of parts shown in FIG. 5, it will be apparent that, if the load support and cam follower unit 60 is rotated or oscillated about the axis of the rod 74, the rod 74 and the portions affixed thereto, including the basket 64, will undergo axial movement as well as the oscillatory or rotational movement undergone by the unit 60. Accordingly, it is necessary only to supply rotary or oscillatory motion in a single plane in order to obtain a two axis motion of the article receptacle and the articles contained therein.

Figure 4:
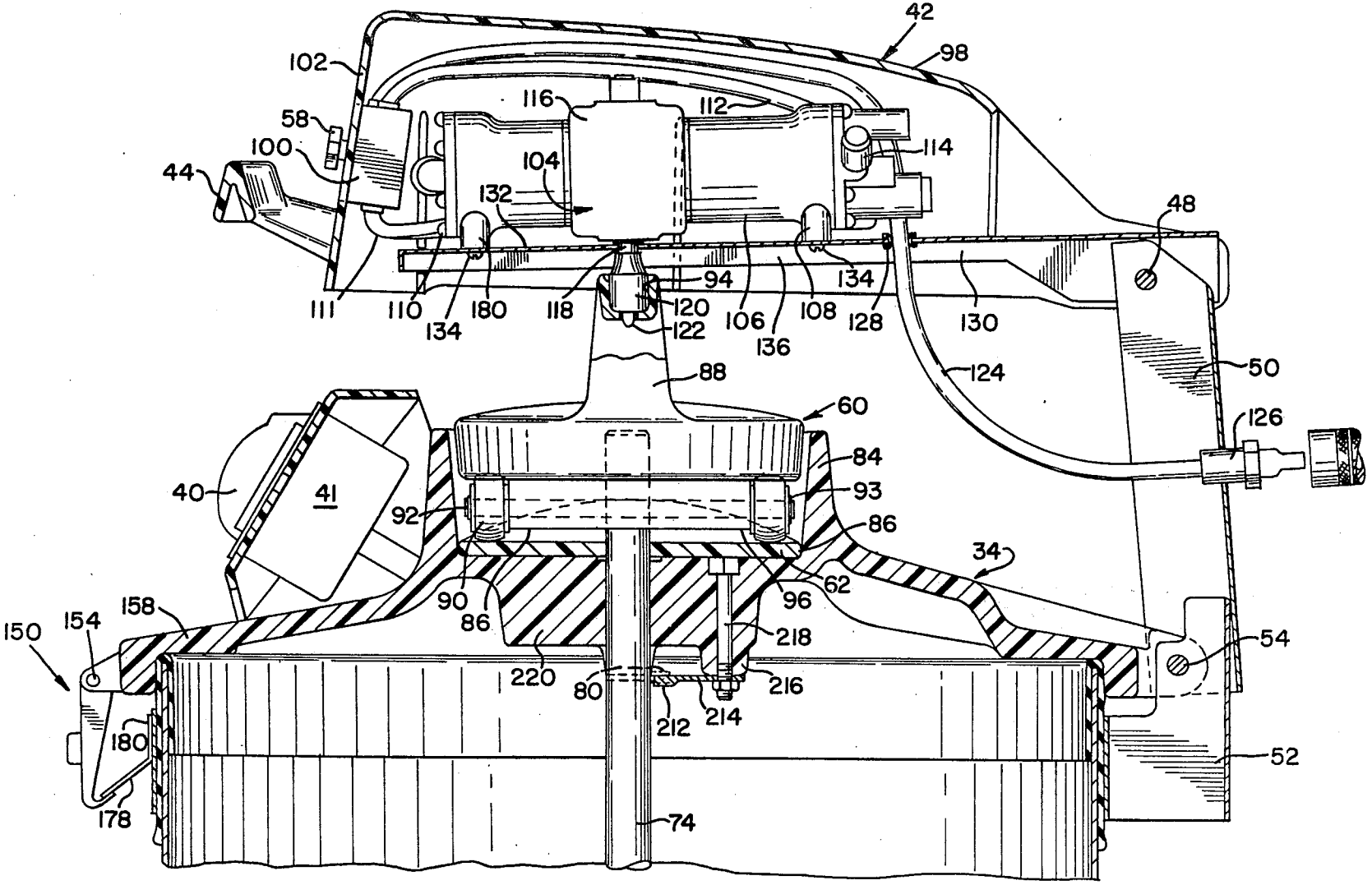
FIG. 4 is a vertical sectional view, on an enlarged scale, showing the constructional features of the powerhead and the drive mechanism of the article washer as well as other detailed features thereof.

Referring now to FIG. 4, additional details of construction of the washer unit and the mounting means therefor are shown. Referring first to the power head 42, it will be noted that this unit includes an outer cover shell 98, and that a motor speed control 100 is affixed to a downwardly and forwardly extending portion 102 of the cover 98. The knob 58 extends through the wall 102 and rotation thereof varies the amount of air flowing through the lines to control the speed of the motor.

The motor unit itself, generally designated 104, is of a type which is conventional and well known to those in the art. Typically, such a motor is one of the type used to operate the windshield wipers on large, over-the-road trucks. This motor unit 104 is shown to include a body 106, mounting feet 108, a forward pressurized air inlet generally designated 110 and served by a hose 111 and a similar rear inlet (not shown), served by the pressure hose 112. The motor is a double acting motor, that is, one which is powered in both directions of motion. The motor also includes a vent and silencer unit 114 for discharge of air.

The body 106 includes a central drive hub portion 116, from which a drive axle 118 extends outwardly. The axle 118 terminates in an oval shaped drive knob 120 having a guide or indexing boss 122 on the bottom thereof. The unit motor 104 is supplied with air under pressure from the line 124, one end of which is attached to a quick-connect fitting 126, and the other end of which serves the control unit 100.

A rubber grommet 128 protects the hose from abrasion where it enters the floor 132 of the head 42 from the exterior thereof. The shell 98 is secured over the frame portion (generally designated 130) of the power head 42, and includes, in addition to the floor portion 132, a pair of side flanges 136 and end flanges 137 through which the axle 48 extends. Fasteners 134 secure the feet 108 of the motor 104 to the floor 132.

FIG. 4 also shows details of the container cover 34, including the sidewalls 84, the cam plate 62 and the load support and cam follower unit 60. In FIG. 4, the axle housing 72 is shown to be disposed in the lowermost position of use with respect to the plate 62; in this position, the wheels 90 rest on the lowermost portions of the cam track surface 96. According to the invention, the surface 96 includes both raised and lowered portions and undulates as is also shown in FIG. 5. The timer 41 operated by the knob 40 is a conventional clock movement timer which can be set to any desired interval, such as half an hour, for example, and will thereafter ring an alarm to indicate that the desired duration of article immersion has occurred.

FIGS. 4 and 6–9 show other details of the various clamp units forming a part of the immersion cleaner 20. Referring particularly to FIGS. 4, 6 and 7, a cover hold down latch assembly, generally designated 150, is shown to include a toggle type locking lever 152 pivotally attached, as at 154, to a bracket 156 which is secured to the rim portion 158 of the cover assembly 34. The latch assembly 150 also includes a hook unit 160, which in turn includes a lower hook 162 having a threaded shank 164 received in a threaded cylindrical opening 166 in a hook-receiving tube 168. A collar 170 is affixed to the hook 162. A latching button 172, having a beveled surface 174 is biased upwardly by the spring 176 which is disposed between the collar 170 and the lower part of the button 172. This button 172 includes a slot 182 which engages a margin 184 on the lever 152, while the nose portion 175 of the button 172 extends through the opening 186 defined by the inner margins 184 provided on the front surface of the lever 152. The lower end of the hook 162 engages the lower portion 178 of a locking tongue 180 which is fixedly secured to the clamp assembly 126.

While the lever 152 is pivoted at the point 154, the tube 168 which holds the hook is in turn pivotally attached to the lever 152 by a pin 188 extending between sidewalls of the lever 152. Consequently, when it is desired to latch the cover 34 in place, the lower or remote end of the lever 152 is raised, lowering the pivot pin 188 and the nose of the hook 162. Then, the open end of the hook is slipped beneath the lower surface 178 of the tongue 180, and as the lever 152 is moved downwardly, the pin 188 is raised, placing the entire hook assembly in tension. The locking button 172 is depressed against the resistance of the spring 176; and when the lever 152 is fully closed, the button 172 is released. The spring 176 biases the button 172 upward so that the slot 182 therein engages the margin 184 defining the opening 186 in the lever 152. This prevents the lever from snapping upward and releasing the cover. The exact adjustment of the required tension is accomplished by rotating the hook 162 so as to create more or less mutual engagement of the threads 164 with the threads defining the tube opening 166.

Referring now to FIGS. 8 and 9, details of the container clamp assembly 26 are shown. The strap 27 includes a handle mounting bracket 190 at one end thereof, and a locking assembly 192 at the other end thereof. A pivot pin 194 connects the bracket 190 to the clamp handle 28, and an over-center link 196 extends from the other end of the handle 28 to the locking assembly 192. A pivot pin 198 is provided at one end of the link 196 for fastening to the handle 28, and another pin 200 at the other end of the link 196 rides within an elongated slot 202. An extensible coil spring 204 is pinned at one end 206 thereof to a stationary mount 208, while the other end 210 of the spring 204 engages the pin 202.

When the handle is in the open position shown in FIG. 9, the spring 204 is relaxed and the strap 27 relatively loosely encircles the upper margin 22 of the container 24. When the handle 28 is pushed radially inwardly, the link 196 pivots into the position thereof shown in FIG. 8, thereby tending to reduce the diameter clamp 27 and tension the same around the container. The spring provides resistance to this action, but because the end of the slot 202 is radially outward of the pin 206, an over-center action is provided and the clamp handle tends to remain closed. This secures the entire immersion cleaner unit 20 over the container 24 and insures that the cover 34 may easily be opened and may be latched in a closed position. This in turn insures that the head 42 and the means mounting it will remain fixed with respect to the container during operation.

Referring to another detailed feature of the invention, the stop pin 80 previously described and shown in FIG. 5, is adapted to engage a small knotch 212 on a flange 214 which extends outwardly from a boss 216 on the lower portion of the cover unit 34. A fastener 218 extending downwardly from the center section 220 of the cover 34 secures the flange 214 to the boss portion 216. In use, the handle 88 is raised until the stop pin 80 engages a portion of the flange 214. Then, the handle and the rod affixed thereto are rotated so that the pin 80 clears the flange 214 whereupon the rod can be raised about another one-half inch, for example. Then the handle is rotated slightly back unitl the pin is in position of engagement with the flange 214 and the handle is then positioned by "feel" until the pin 80 is received within the depressed portion or knotch 212 on the flange, securing the rod 74 and handle 88 against rotation and locking the basket attached thereto in the fully raised position. In the position of the components just described, opening the cover 34 will further raise the basket and expose the open portion thereof for loading or unloading; if the pin 80 is not engaged by the knotch 212 or another portion of the flange 214, the cover will not be able to be opened materially because engagement between the lower part of the rod 74 and the basket 64 would prevent substantial sideways movement of the lower portion of the rod 74.

Referring now to the use of the apparatus, it will be assumed that the immersion cleaner is ready for use, with the container 24 being filled with cleaning liquid to an appropriate level. The button 172 on the cover clamp is moved vertically, and the lever 152 is raised upwardly until the hook 162 disengages the lower portion 178 of the locking tongue 180. The power head 42 is lifted and rotated about both pivot points 48, 54 so that it lies fully away from the container, in the phantom line position of FIG. 3.

Next, the handle 88 is pulled vertically and manipulated so that the stop pin 80 on the rod 74 engages the knotch 212 on the basket support flange 214. This locks the basket or receptacle 64 in the uppermost position. Thereupon, the cover assembly 34 is raised by moving the handles 36 in an arc until the cover 34 is in the phantom line position of FIG. 3 and the basket is in the fully raised position thereshown. Thereupon, the receptacle 64 for the articles is filled, such as with carburetors or carburetor parts, and the cover 34 is pivoted back into the closed position. The handle 88 is then twisted so that the pin 80 disengages the flange 214, permitting the handle 88 and the receptacle support and cam follower assembly 60 to be lowered as a unit, and permitting the receptacle 64 to be immersed in the fluid in the container 24.

The cover is re-latched and the lever 152 manipulated in a reverse manner as described above so as to secure the cover over the container 24 and hold it in a fixed position relative to the clamp assembly 26.

Thereupon, the power head unit 42 is first raised and then lowered into the position of FIG. 1. At this time, the handle 88 is positioned so that the recess 94 therein can receive the oval shaped drive knob 120 which is affixed to the motor drive axle 118. The power head is then resting on the combination cam follower and load support unit 60 and is free to pivot about the axis of the pin 48, and/or the axis of the pin or pivot 54.

When it is desired to wash the parts, the timer knob 40 is set to a desired time, and the motor control knob 58 is rotated from the off position to an "on" position and set for a suitable speed. The motor unit 104 operates pneumatically, receiving air through the line 124 and directing the compressed air alternately through lines 111 and 112 to cause reciprocation of the pistons therein and produce an oscillating action in the drive shaft 118. This occurs in a manner known to those skilled in the art, and inasmuch as the details of the drive motor do not form a part of the invention which is novel per se, further description thereof is omitted. The oscillating movement of the motor shaft 118 and engagement between the knob 120 and the recess 94 causes the handle 88 and the remainder of the cam follower and load support unit 60 to oscillate. In so doing, the wheels 90 ride vertically up and down, i.e., axially, of the undulating cam track surface 96.

Inasmuch as the support rod 74 is fixedly attached to the unit 60, and because the hook 72 does not permit angular rotation of the receptacle 64 relative to the axis of the rod 74, the basket or receptacle 64 containing the articles undergoes not only an oscillating action, or a clockwise and counterclockwise rotation within the liquid as seen from the top, but also undergoes an up and down motion when viewed from the side. Such a compound action is highly effective in cleaning parts.

An important feature of the invention is that the power head is free to pivot or oscillate about the pin 44, and accordingly, no positive drive is required to create the oscillating motion. The power head unit as a whole simply rides up and down on the cam track in response to the oscillating movement of the cam follower assembly 60. The speed of the motor is controlled, within limits, by manipulation of the knob 58.

The flexible hose 124 permits the slack connection necessary to permit the floating or pivoting drive feature which in turn permits the simultaneous axial and rotary movement of both the power head and cam follower. When a suitable time has elasped and it is desired to remove the parts, the motor is shut off by manipulating the knob 58, the handle 88 is lifted and turned until the pin 80 engages the notch 112 in the flange 114. Then the cover handle 44 is grasped and the cover is lifted about the pivot point 54 so it can be laid back into the position of FIG. 3. The cycle may then be repeated as described above.

Figure 3:
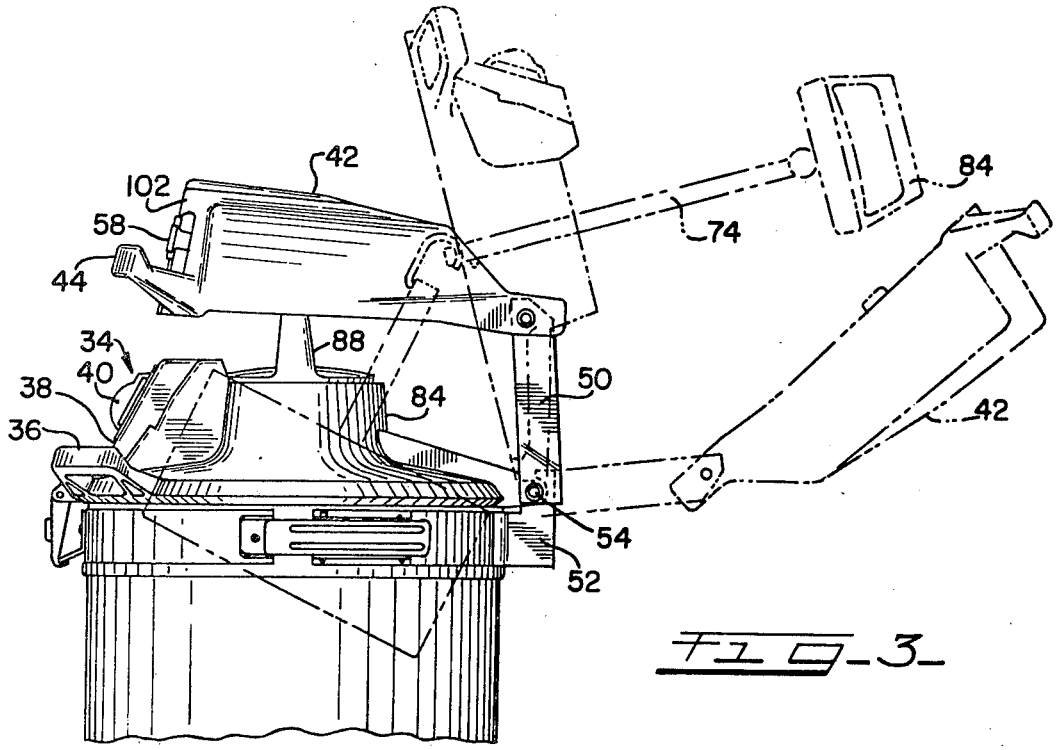
FIG. 3 is a side elevational view of one form of article cleaner made according to the invention and showing, in phantom lines, the manner of opening the apparatus for removal of articles therefrom.

Assuming now that it is desired to remove the entire unit for maintenance, the handle 28 may be grasped by the operator and pulled outwardly to the position shown in FIG. 9. This releases the clamp and permits the entire immersion cleaner 20 to be removed as a unit from the receptacle 24. This may be done if it is for maintenance purposes or otherwise, but need not be done for changing the cleaning fluid, which may be achieved by raising and removing the receptacle 64 as shown in FIG. 3.

Figure 2:
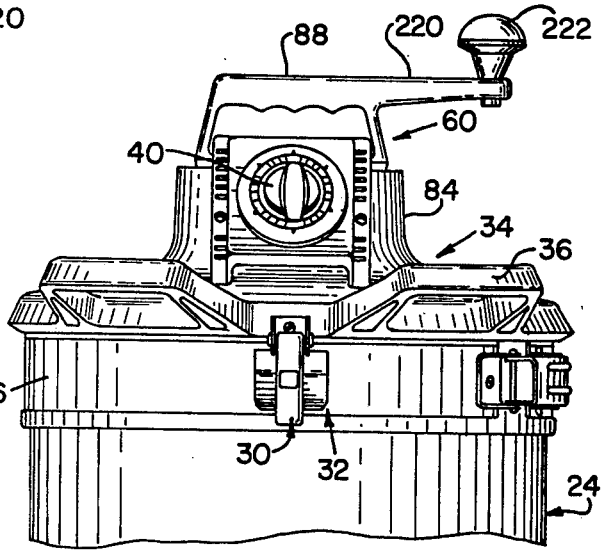
FIG. 2 is a front elevational view with the bottom portion broken away, and showing a form of article cleaner made according to the invention and adapted for manual operation.

Referring now to FIG. 2, a form of apparatus is shown which is identical to that shown in FIGS. 1 and 3–9, except that an arm 220 extends outwardly from the handle 88 of the support and cam follower unit 60. A knob 222 is provided on the end of the arm 220 so that the unit 60 may be manipulated. In this case, the unit is reciprocated by hand, and the cam supplies the axial component of the motion. Moving the handle in this way also serves to clean the parts with the novel combination oscillating and vertically reciprocating movement. In the case of this form of cleaner, the power head unit is not provided, and washing occurs merely by immersion or by immersion and movement of the unit by hand. In other respects, the embodiment of the invention shown in FIG. 2 may be the same as that shown and described in detail above.

The present invention provides different forms of immersion type cleaner units which provide a type of mechanical motion found most desirable for parts cleaning but achieves this by using simple and readily available mechanical components including, for example, a simple windshield wiper motor. The compound or dual axis washing motion is achieved without the use of complex combination cam drives or the like. The provision of the "floating" head and the positive drive connection between the power head and the cam follower unit, in combination with the slight working clearances between the knob 120 and the recess 94, provide freedom from maintenance, longevity in use and simplicity and economy of operation. The cover is secured tightly against the release of vapors and the like from the cleaning fluid, and yet the unit may be simply opened and closed for servicing or inspection of parts. The basket or receptacle is able to be indexed and held in a desired position for opening and inspection.

The unit thus provides a combination of easy servicing and good washing action with a simple mechanism and low cost. The ready removability makes it possible to use replacement containers, and simplifies servicing and change of container types or materials if this is required for use with different solvents or cleaning fluids. It is also advantageous to service the unit by complete replacement of containers of new liquid from time to time, such serviceability being an important advantage of the apparatus of the invention.

While various materials are suitable for use in the invention, it is preferred that the drum or like container 24 be made from an inert plastic material such as a dense polyethylene or polypropylene. The cover is preferably an injection molded polypropylene or like material, while the cam plate may be a harder material such as nylon, an acetal resin or the like. The cam follower and load support unit 60 may also be made from a harder plastic material such as a dense polypropylene, an acetal, or a polycarbonate. The rollers 90 may be made from nylon and the axle 92 and the wheel retainers 93 may be made from stainless steel, as is the rod 74. The clamp and latch assemblies are also preferably made from stainless steel while the middle portions of the head 42, such as the floor 132, the flanges 130 and the vertical support unit 50 may be made from thin steel stampings. The power head shroud or cover 98 is made from a flexible plastic material, while the motor 106 and controls are made from die cast metal. The lines 111, 112 and 124 are preferably plastic tubing, and the timer 41 is a purchased unit normally made largely from metal and containing a plastic knob 40.

Other suitable materials may be used but the foregoing have proved to combine the advantages of being chemically inert, resisting corrosion, providing long life in use and low manufacturing cost.

It will thus be seen that the present invention provides a novel immersion type cleaning unit having a number of advantages and characteristics including those pointed out herein and others which are inherent in the invention. Several preferred embodiments of the invention having been described by way of illustration, it is anticipated that changes and modifications of the described immersion cleaner will occur to those skilled in the art and that such changes and modifications may be made without departing from the spirit of the invention or the scope of the appended claims.

I claim:

1. A driving element and support assembly therefore, comprising, in combination, a clamp for encircling a liquid receiving container, a generally vertically extending head support element, including upper and lower end portions thereof, means in a part of said lower end portion pivotally attaching said lower end to a portion of said clamp, a head assembly including a frame element adapted, in a position of use, to extend generally horizontally, means for forming a pivotable connection between one end of said frame element and said upper end of said vertical member, a motor attached to said frame element, a drive shaft extending generally downwardly from said motor, a driving element disposed on said drive shaft and adapted for removable reception into a drive element receiving recess in an associated driven member, said pivotal attachment of said lower end of said vertical member to said clamp permitting said upper end of said vertical member to pivot radially inwardly and outwardly with respect to said container, and said pivotal connection between said upper end and said frame permiting said head to oscillate vertically, said clamp and said vertical member and said frame member providing a reaction member for absorbing the driving torque of said motor, whereby in use, said drive head may be associated in use with a driven member undergoing both radial and axial oscillation, may remain in driving contact with said member at all times during said drive cycles and may be freely removable therefrom by pivoting said head assembly upwardly about said second pivot point.

2. A simplified drive unit for applying an oscillating driving force to a submersible basket assembly which includes a driven member portion adapted to undergo radial oscillating motion and also capable of undergoing axially oscillating motion, said drive unit comprising a drive head assembly having a head frame portion and a motor received on a portion of said head frame, said frame also having an attachment portion adapted to cooperate with one end of a generally vertically extending head support portion to form a hinge assembly, said hinge assembly having a generally horizontal pivot axis and being adapted to pivot freely upwardly and downwardly about said axis, said head support portion having means for attachment to a container adapted to receive said submersible basket, a drive assembly including a shaft extending downwardly from said motor and a drive element attached to a lower portion of said shaft, said drive element being adapted to extend downwardly and be received in cooperative relation with a drive element receiving recess in said driven member portion of said basket assembly, said simplified drive unit being thereby adapted to rest upon and be supported against vertical movement by said driven member portion of said basket assembly, said head being pivotable about said pivot axis so as to be freely removable from said driven member by upward pivotal movement, said pivot also permitting axial oscillation of said head when said driven member oscillates axially in use, said head assembly being urged downwardly into an engaged position of said drive element and said driven element by the weight of said motor.

3. A drive unit as defined in claim 2 wherein said motor is disposed in use generally centrally above said driven member, and wherein said drive element extends generally downwardly from said motor from the center portion thereof.

4. A drive unit as defined in claim 2 wherein said vertically extending head support portion includes a lower part having means forming a part thereof for pivotal attachment to an associated container, and whereby said vertical member undergoes slight pivoting action in use as said head oscillates vertically.

5. A drive unit as defined in claim 2 wherein said head assembly further includes a handle forming a part thereof to facilitate lifting said head to disengage said head from a driven element, and to facilitate supporting said head when manipulating said drive element and said driven member for alignment thereof in driving relation.

6. A drive unit as defined in claim 2 wherein said head frame portion forms a lower part of said head assembly, said head assembly including a shroud removably attached to said frame, and wherein said motor includes a control forming a part thereof and extending through said shroud.

* * * * *